US007406785B2

(12) United States Patent
Noguchi

(10) Patent No.: US 7,406,785 B2
(45) Date of Patent: Aug. 5, 2008

(54) DISPLAY DEVICE

(75) Inventor: Kunihiko Noguchi, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 290 days.

(21) Appl. No.: 11/076,097

(22) Filed: Mar. 9, 2005

(65) Prior Publication Data

US 2005/0200560 A1 Sep. 15, 2005

(30) Foreign Application Priority Data

Mar. 10, 2004 (JP) ..... 2004-067976

(51) Int. Cl.
*G09F 13/00* (2006.01)

(52) U.S. Cl. ..... 40/442; 40/444; 40/581

(58) Field of Classification Search ..... 40/442, 40/581, 444; 362/561, 559, 612, 613, 627
See application file for complete search history.

(56) References Cited

U.S. PATENT DOCUMENTS

| | | | | | |
|---|---|---|---|---|---|
| 770,319 | A * | 9/1904 | Rudiger | 40/443 |
| 1,881,417 | A * | 10/1932 | Hodgkin | 40/443 |
| 4,180,931 | A | 1/1980 | Osch | |
| 5,003,715 | A * | 4/1991 | Steiner | 40/442 |
| 5,251,392 | A * | 10/1993 | McManigal | 40/427 |
| 5,390,436 | A | 2/1995 | Ashall | |
| 5,657,563 | A * | 8/1997 | Lane | 40/219 |
| 6,212,805 | B1 * | 4/2001 | Hill | 40/443 |
| 6,417,779 | B1 | 7/2002 | Noll et al. | |
| 6,534,158 | B2 * | 3/2003 | Huang et al. | 428/201 |
| 6,722,066 | B1 * | 4/2004 | Cheung | 40/581 |
| 7,024,809 | B1 * | 4/2006 | Poma | 40/546 |

FOREIGN PATENT DOCUMENTS

| | | |
|---|---|---|
| EP | 0 795 775 A2 | 9/1997 |
| JP | 2001-100679 A | 4/2001 |

* cited by examiner

*Primary Examiner*—Lesley D. Morris
*Assistant Examiner*—Rita K Sinha
(74) *Attorney, Agent, or Firm*—Foley & Lardner LLP

(57) ABSTRACT

A display device selectively provides a first and second displays. A first light source emits first light, and a second light source emits second light having peak wavelength different from the first light, and a translucent sheet hit selectively by one of the first and second lights. The translucent sheet has first printed area parts formed on a first surface of the sheet to pass only the first light for providing the first display, second printed area parts formed on the first surface to pass only the second light for providing the second display, third printed area parts formed on the first surface to prevent light transmittance, and printed dimmer area parts formed on a second surface at areas corresponding to overlapped area parts of the first and second displays so as to suppress the first and second lights.

12 Claims, 14 Drawing Sheets

DISPLAY DEVICE

BACKGROUND OF THE INVENTION

1. Field of the Invention

The present invention relates to a display device that is capable of shifting different display contents on the identical display surface of the display device.

2. Description of the Related Art

A display device of this kind is disclosed in Japanese patent laying-open publication No. 2001-100679. This display device has a first printed area through which only blue light can pass and a second printed area through which only green light can pass, the other printed area to form a lightproof background, which are formed by printing on a rear surface of a transparent sheet that is illuminated from a rear side of the sheet by a first light source of blue light and a second light source of green light.

The above known conventional display device, however, encounters a problem that a display device requires a high-precision printing process, resulting in a high manufacturing cost, because all the areas are printed on one side of the sheet and the three printed areas are formed adjacently to one another. In addition, in a case that the adjacent printed areas are overlapped with each other, their overlapping area parts stand out to impair display, while in a case that the adjacent areas have a gap between them, the light from the light sources passes through the gap, resulting in the deterioration of the display quality.

It is, therefore, an object of the present invention to provide a display device which overcomes the foregoing drawbacks and can obtain high display quality at a lower manufacturing cost and prevent light leakage without using a high-precision printing process.

SUMMARY OF THE INVENTION

According to a first aspect of the present invention there is provided a display device that selectively provides a first display and a second display, which includes a first light source to emit a first light, a second light source to emit a second light having a peak wavelength different from the wavelength of the first light, and a translucent sheet that is hit selectively by one of the first and second lights. The translucent sheet has a first surface and a second surface opposite to the first surface, and also has a first printed area part, a second printed area part and an overlapping area part of the first and second display. The overlapped area part is a non-printed area part and is directly connected with the first and second printed area parts to respectively form a part of the first and second displays. The first printed area part is formed on the first surface of the translucent sheet to provide the first display, excluding a part corresponding to the overlapped area part through which the first and second light can pass. The first area part is capable of passing only the first light such that the first printed area part and the overlapped area part provide the first display when the first light is emitted, and the second printed area part is formed on the first surface to provide the second display, excluding a part corresponding to the overlapped area part. The second printed area part is capable of passing only the second light such that the second printed area part and the overlapped area part provide the second display when the second light is emitted. A third printed area part is formed on the first surface to prevent transmittance of the first and second lights and forms a background, and a printed dimmer area part is formed on the second surface so as to cover the overlapped area part and decrease the brightness difference between the first and second lights which pass through the overlapped area part and the first and second lights which pass through the first and second printed area parts, respectively. The printed dimmer area part is formed to have an area larger than an area of the overlapped area part so as to overlap with a portion of the first printed area part, which abuts on the overlapped area part, and a portion of the second printed area part, which abuts on the overlapped area part. The first and second displays can be displayed uniformly in brightness between the overlapped area part and the first printed area part and between the overlapped area part and the second printed area part when the first and second light are emitted, respectively.

Therefore, this display device can obtain high display quality at a lower manufacturing cost and prevent light leakage without using a high-precision printing process.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENTS

Figure 1:
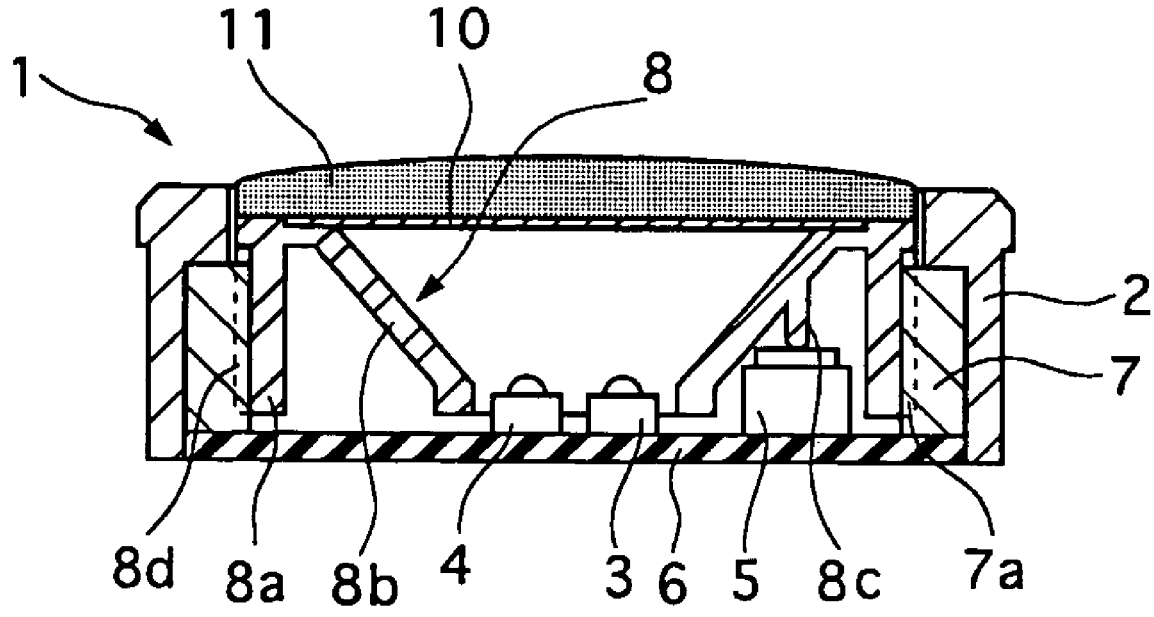
FIG. 1 is a cross sectional side view of a switch with a display device of a first embodiment according to the present invention.

Throughout the following detailed description, similar reference characters and numbers refer to similar elements in all figures of the drawings, and their descriptions are omitted for eliminating duplication.

Referring to FIGS. 1 to 10 of the drawings, there is shown a first preferred embodiment of a display device according to the present invention. In this embodiment, a switch has a display device capable of providing different displays.

A switch 1 has a switch finisher 2, a guide member 7 fixed to a lower and inner part of the switch finisher 2, and a slider 8 arranged inside the switch finisher 8 and capable of sliding rearward and forward.

The switch finisher 2 is shaped like a square-tube, and the guide member 7 is shaped like a square-tube smaller than the switch finisher 2 to be fixed in an inner part of the switch finisher 2 at this rear side.

The guide member 7 is formed on at least two facing inner surfaces thereof with rail portions 7*a* that extend in a back and front direction to receive projections 8*d* formed on outer side-wall surfaces of the slider 8.

The switch finisher 2 and the guide member 7 are fixed at their rear portions by a base plate 6 so that their rear openings are closed up. The base plate 7 is provided with a first light source 3, a second light source 4, a tact switch 5, and a not-shown electronic circuit on its front surface.

Figure 6:
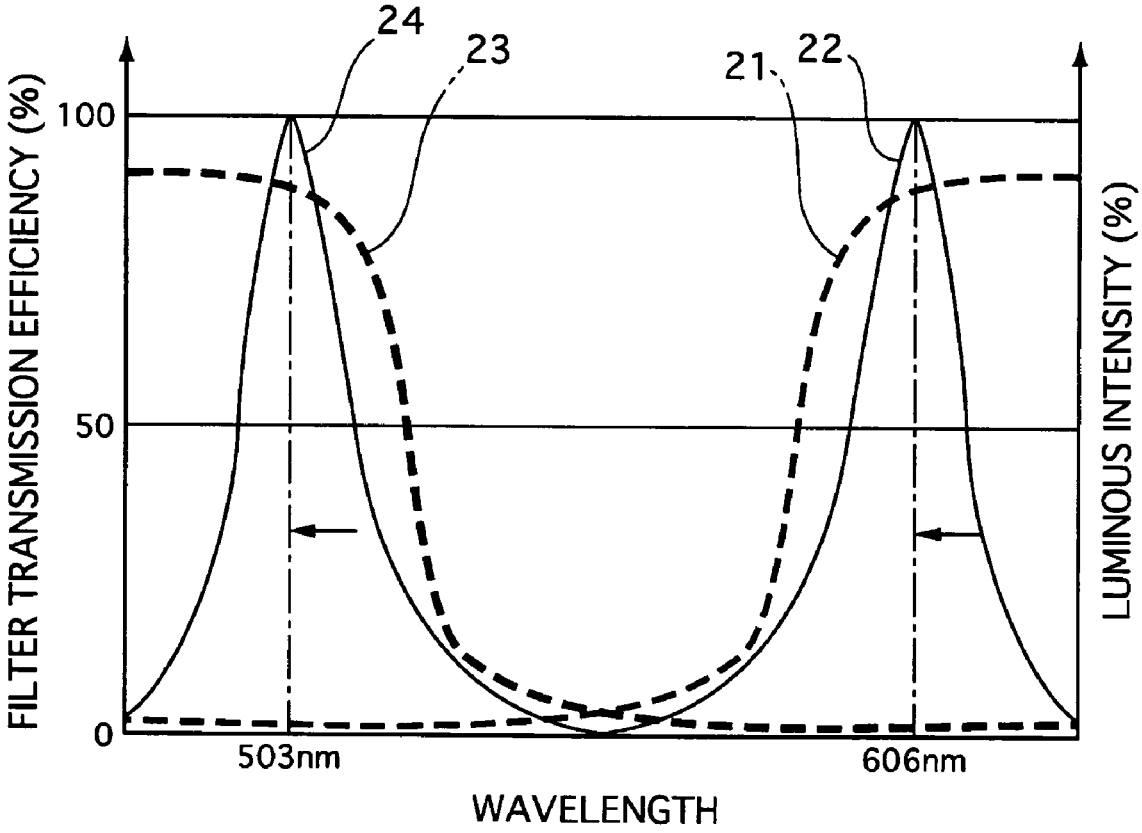
FIG. 6 is a characteristic diagram showing a relationship of luminous intensity of a first and second light sources used in the display device and transmission efficiency of the color filter with respect to wavelength of light.

The first light source 3 is constructed so as to cast first light having a peak wavelength of about 500 nm as indicated by a line 24 in FIG. 6, and the second light source 4 is constructed so as to cast second light having a peak wavelength of about 600 nm as indicated by a line 22 in FIG. 6. These light sources 3 and 4 are made of different-color light emitting diodes (LEDs), which are preferable for a low cost and easy maintenance. The light sources 3 and 4 may be made of other devices.

The slider 8 has a side-wall portion 8*a* to form a square tube, and an inner slanted wall portion 8*b* arranged inside of and integrally formed with the side-wall portion 8*a*. The inner slanted wall portion 8*a* is shaped like a quadrangular-pyramid tube so that its opening becomes narrower from its front end toward its rear end. The rear end opening of the inner slanted wall portion 8*b* is formed so that the light sources 3 and 4 are positioned in the rear end opening, while the tact switch 5 is positioned out of the rear end opening and between the inner slanted wall portion 8*b* and the side-wall portion 8*a*.

The slider 8 is fixed at its front edge side and inside thereof with a color filter 10 with printed area parts, which will be described in detail later. A smoked lens 11 is arranged on a front surface of the color filter 10 to cover it. The smoked lens 11 has a low translucency in its whole area so that he or she can not see printed patterns of the printed area parts provided on the color filter 10 through the smoked lens 11 in an outside light at lights-out time.

The tact switch 5 is switchable between ON and OFF according to backward and forward movements of the slider 8. Specifically, the tact switch 5 is kept in contact with a projecting portion 8*c* projected rearward from an outer surface of the inner slanted wall portion 8*b* for switching. When a user presses a front surface of the smoked lens 11, the slider 8 moves back together with the smoked lens 11 and the color filter 10 along the rail portions 7*a* of the guide member 7. This causes the projecting portion 8*c* of the slider 8 to press the tact switch 5. Then, when the user releases the smoked lens 11 from being pressed, the tact switch 5 pushes forward and moves the slider 8 to its original position by reaction force of the tact switch 5.

Figure 2:
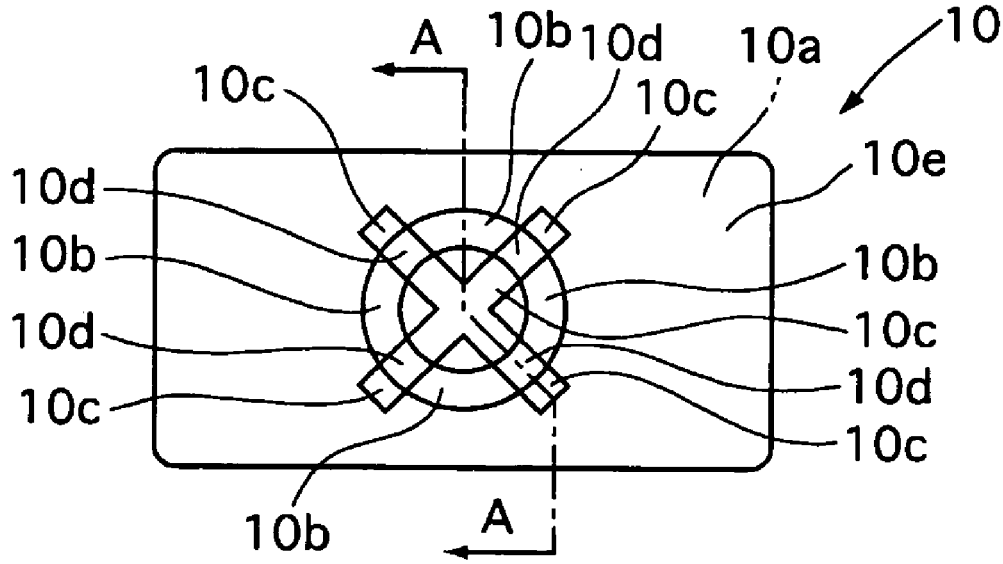
FIG. 2 is a plain view of a color filter with printed area parts used in the display device shown in FIG. 1.
Figure 3:
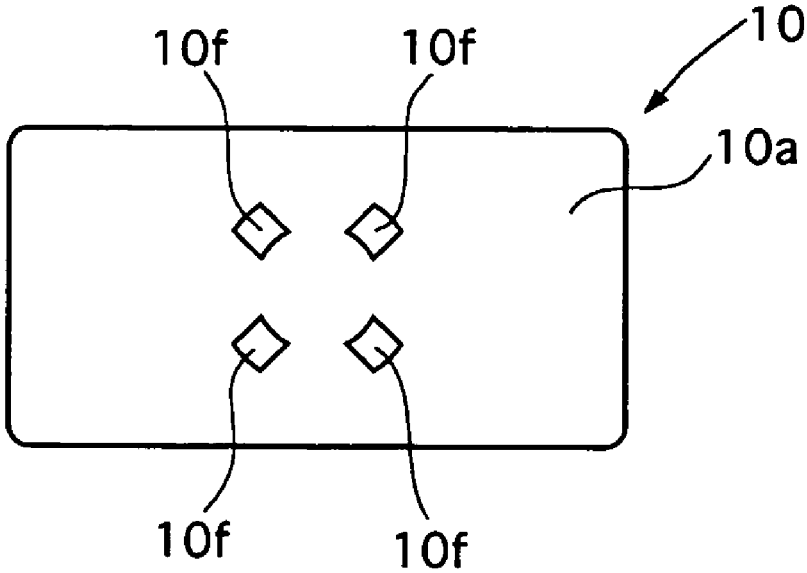
FIG. 3 is a rear view of the color filter with printed dimmer area parts.
Figure 4:
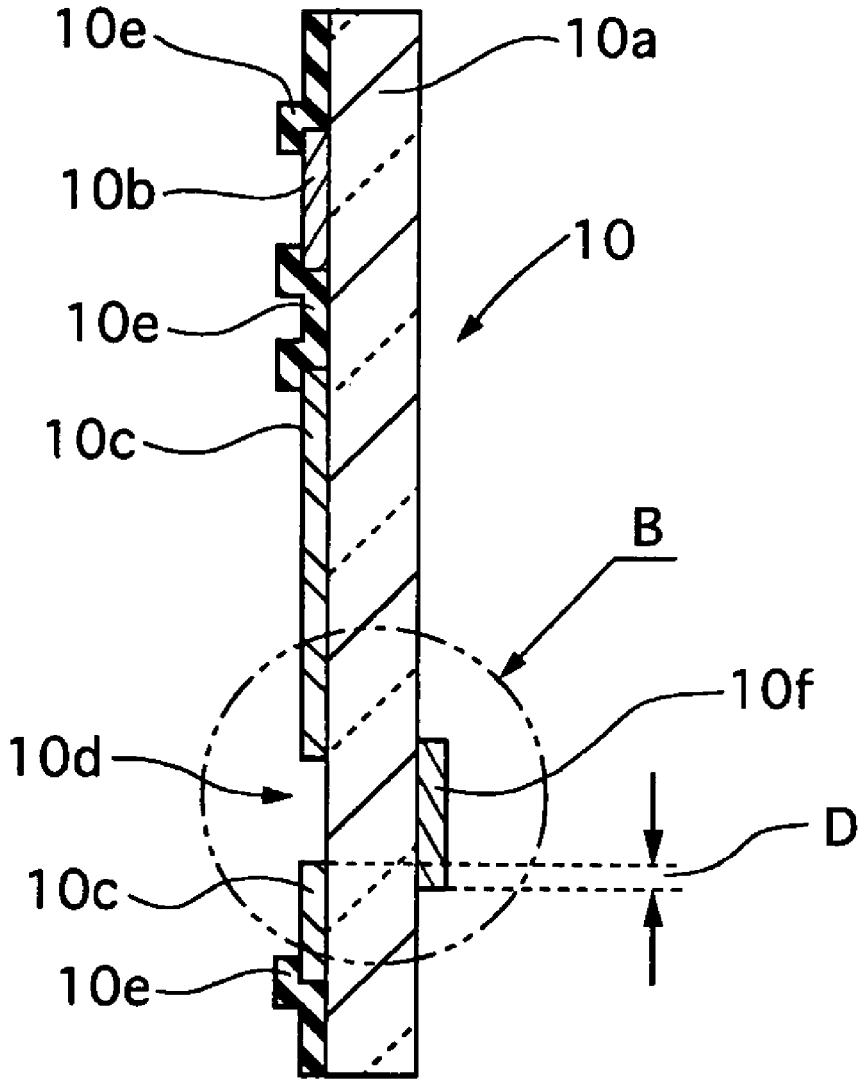
FIG. 4 is a cross-sectional view, taken on line A-A of FIG. 1, of the color filter with the printed area parts.
Figure 8A:
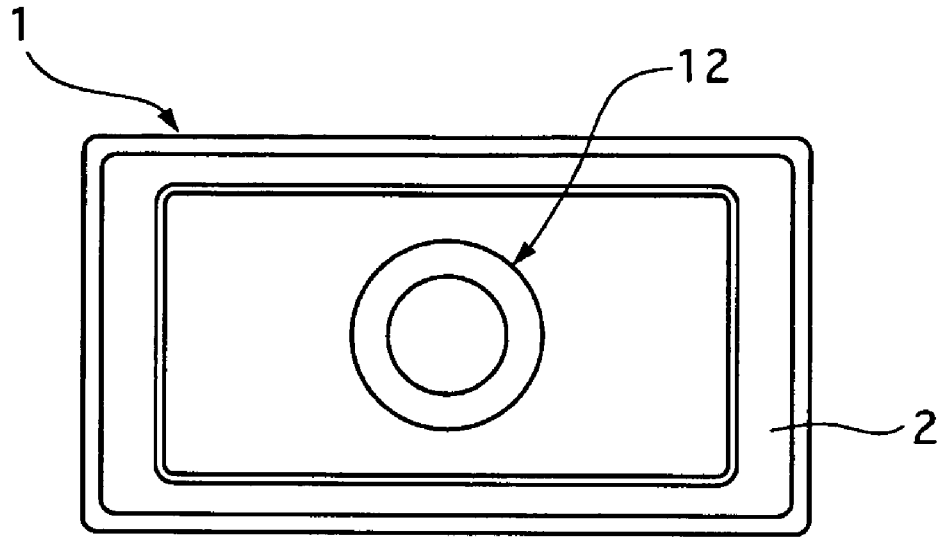
FIG. 8A is a plain view of the display device shown in FIG. 1 in a state that the display device provides a first display.
Figure 8B:
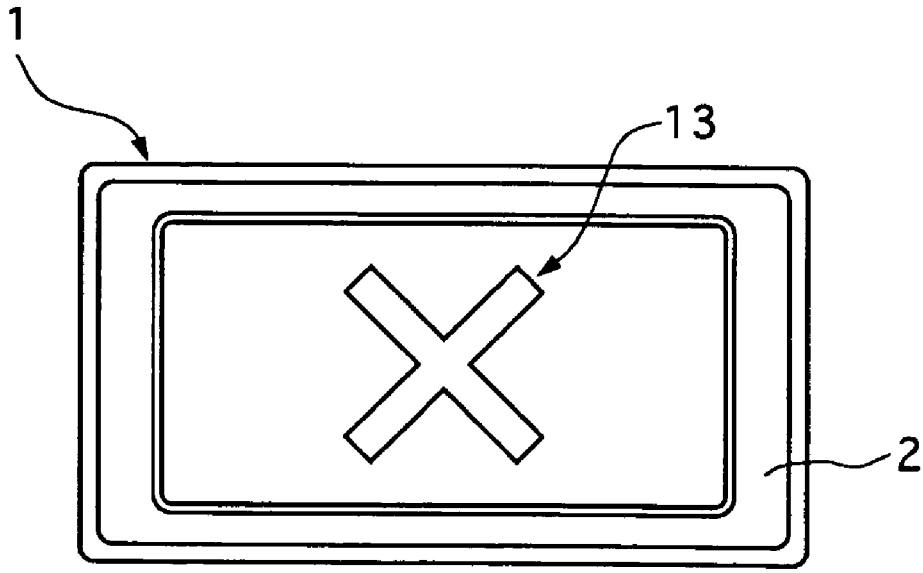
FIG. 8B is a plain view of the display device in a state that the display device provides a second display.
Figure 9A:
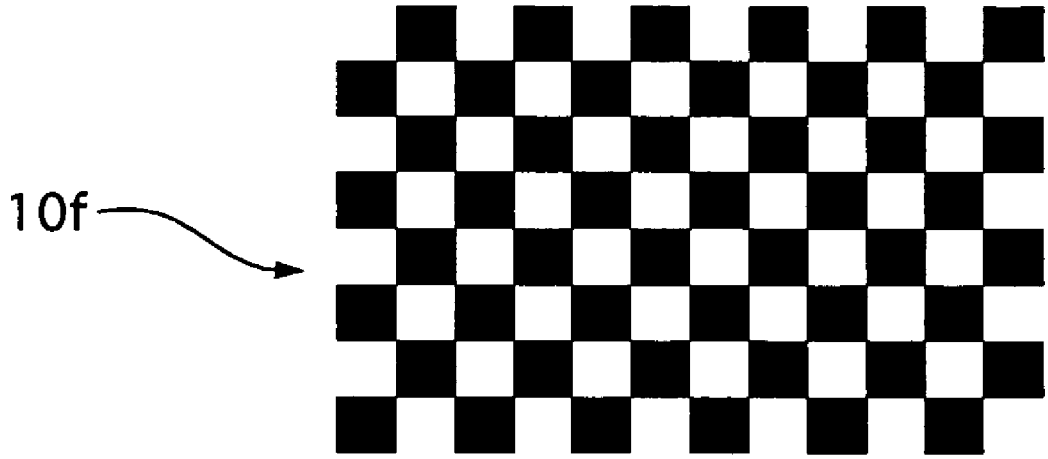
FIG. 9A is a fragmentary diagram showing a modified dot pattern in the printed dimmer area parts shown in FIG. 7A.
Figure 9B:
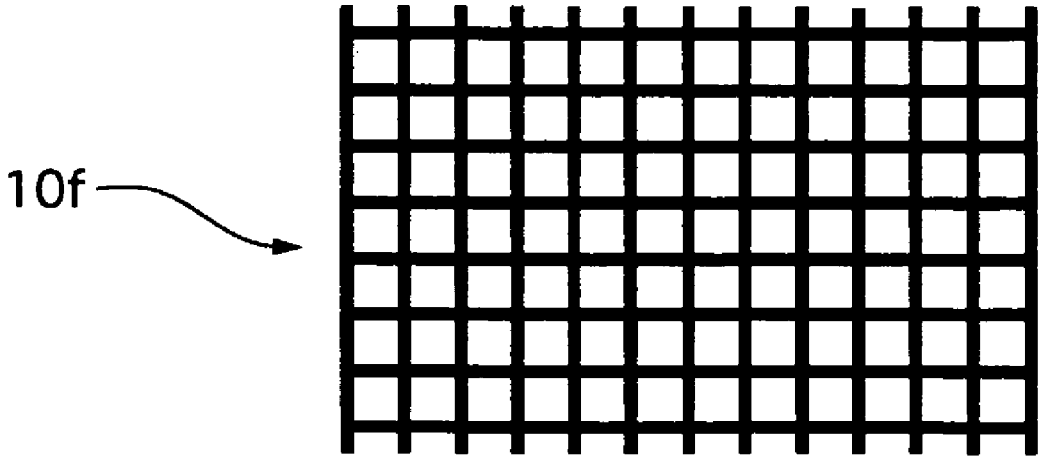
FIG. 9B is a fragmentary diagram showing a modified dot pattern used in the printed dimmer area parts shown in FIG. 7B.
Figure 10A:
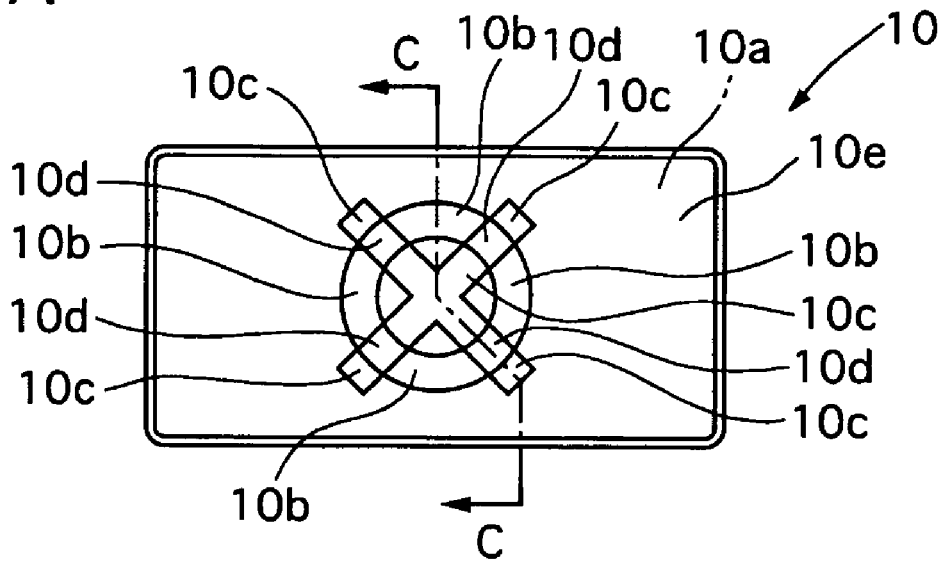
FIG. 10A is a plain view of a color filter used in a display device of a second embodiment according to the present invention.
Figure 10B:
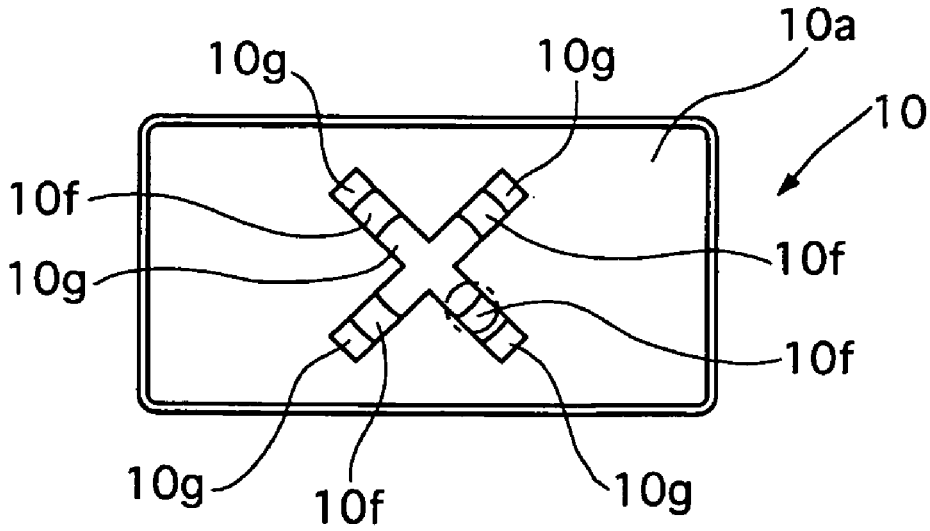
FIG. 10B is a rear view of the color filter.

As shown in FIGS. 2 to 4, the color filter 10 is made of a translucent light-diffusion sheet 10*a* with printed area parts 10*b*, 10*c*, 10*e*, and 10*f* for providing a first display 12 of a graphic symbol indicated by a circle as shown in FIG. 8A and a second display 13 of a graphic symbol indicated by a letter "X" as shown in FIG. 8B. The translucent light-diffusion sheet 10*a* corresponds to a translucent sheet of the present invention.

As shown in FIG. 2, first printed area parts 10*b* are printed on a front surface of the diffusion sheet 10*a* correspondingly to the circle of the first display 12 excluding overlapped area parts 10*d* of the circle of the first display 12 and the letter "X" of the second display 13. The first printed area parts 10*b* are colored blue to pass blue light therethrough, and have transmission efficiency, with respect to wavelength, indicated by a dotted line 23 in FIG. 6. The front surface of the diffusion sheet 10*a* corresponds to a first surface of the present invention and a rear surface of the diffusion sheet 10*a* corresponds to a second surface of the present invention.

Second printed area parts 10*c* are printed on the front surface of the diffusion sheet 10 correspondingly to the letter "X" of the second display 13 excluding the overlapped area parts 10*d* of the circle of the first display 12 and the letter "X" of the first display 3. The second printed area parts 10*c* are colored red to pass red light therethrough, and have transmission efficiency, with respect to wavelength, indicated by a dotted line 21 in FIG. 6.

The first and second printed area parts 10*b* and 10*c* are printed on the front surface of the diffusion sheet 10*a* in a manner such that they have printed areas wider than the first and second displays 12 and 13 so as to protrude from the outer edges of the first and second displays 12 and 13. Then, the printed background area parts 10*e* are printed in black on edge portions of the first and second printed area parts 10*b* and 10*c* so that they define outer edges of the first and second displays 12 and 13 by masking excessive portions of the first and second printed area parts 10*b* and 10*c* as shown in FIG. 4. These printed background area parts 10*e* are made from material that prevents light-transmittance, while the overlapped area parts 10*d* are not printed so as to transmit light. The printed background area parts 10*e* correspond to third printed area parts of the present invention.

Figure 7A:
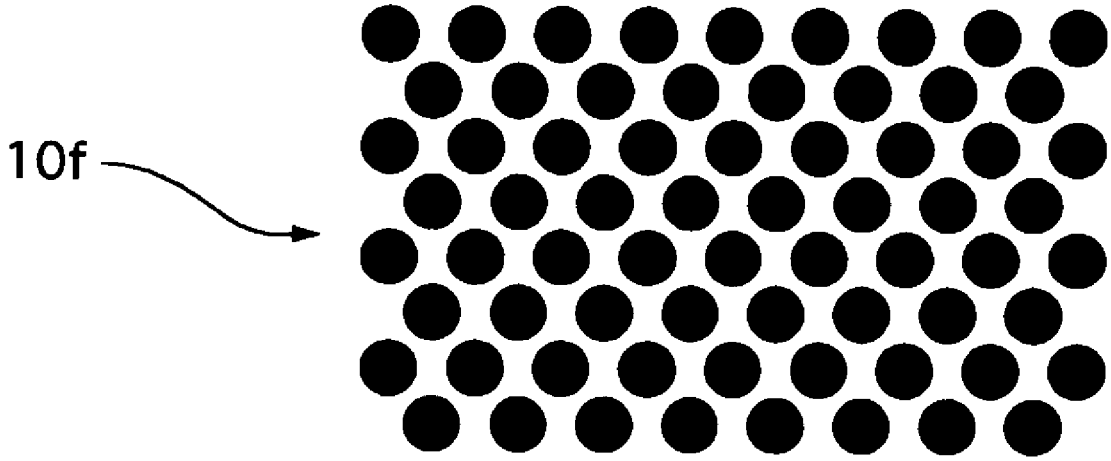
FIG. 7A is a fragmentary diagram showing a dot pattern in the printed dimmer area parts shown in FIGS. 3 to 5.

Printed dimmer area parts 10*f* are printed on the rear surface of the diffusion sheet 10*a* at areas corresponding to the overlapped area parts 10*d* of the first and second printed area parts 10*b* and 10*c*. The printed dimmer area parts 10*f* have a dot pattern in which black rounded dots are arranged regularly and printed as shown in FIG. 7A. The rounded dots are set in diameter and density so as to obtain optimum dimmer effect.

Figure 7B:
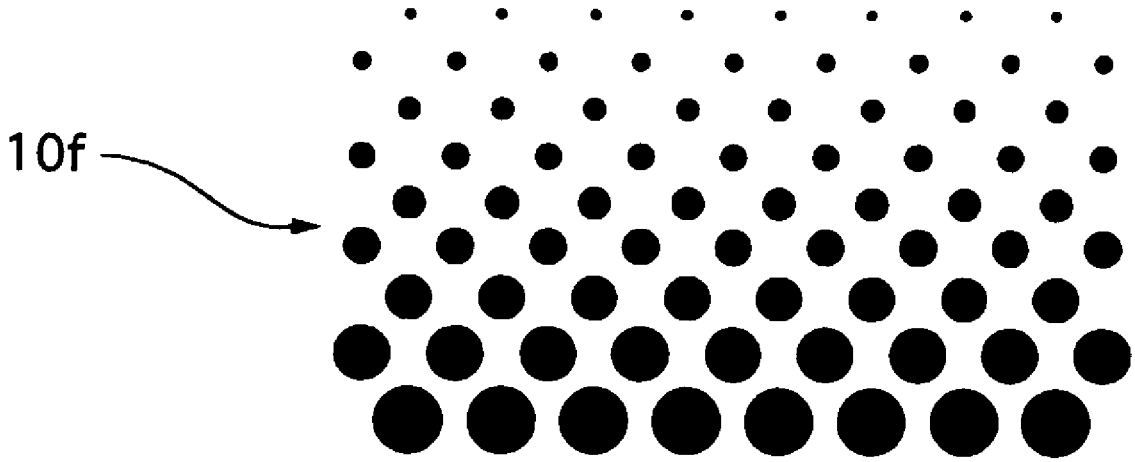
FIG. 7B is a fragmentary diagram showing a gradated dot pattern used in the printed dimmer area parts.

The printed dimmer area parts 10*f* are also formed to cover a projection area of the overlapped area parts 10*d* and have a printed area larger than the overlapped area parts 10*d*. This causes overlapped area portions D of the printed dimmer area parts 10*f* and the first printed area parts 10*b* and of the printed dimmer area parts 10*f* and the second printed area parts 10*c* as shown in FIG. 4. The overlapped area portions D have a dot pattern in which black rounded dots are gradated to be smaller in diameter as shown in FIG. 7B.

The operation and advantages of the switch 1 of the first embodiment will be described.

In order to provide the first display 12, the first light source 3 is turned on to light up, while the second light source 4 is turned off. The blue light is emitted from the first light source 3 in all directions, and travels forward directly and under reflection on an inner surface of the inner slanted wall portion 8*b* of the slider 8. This light hits the color filter 10 from its rear side, and enters the diffusion sheet 10*a* under restraining its brightness, which is determined by the area rate of black dots and remaining portions of the printed dimmer area parts 10*f* formed on the rear surface of the diffusion sheet 10*a*, because the light is prevented from transmitting through the black dots, but the remaining portions can transmit the light. This means that the amount LI of light inputted into the diffusion sheet 10*a* is expressed by the following equation:

$$LI=Ar/AD$$

where Ar is an area of the remaining portions (portions excluding the black dots) of the printed dimmer area parts 10*f*, and AD is an entire area of the printed dimmer area parts 10*f*.

Figure 5:
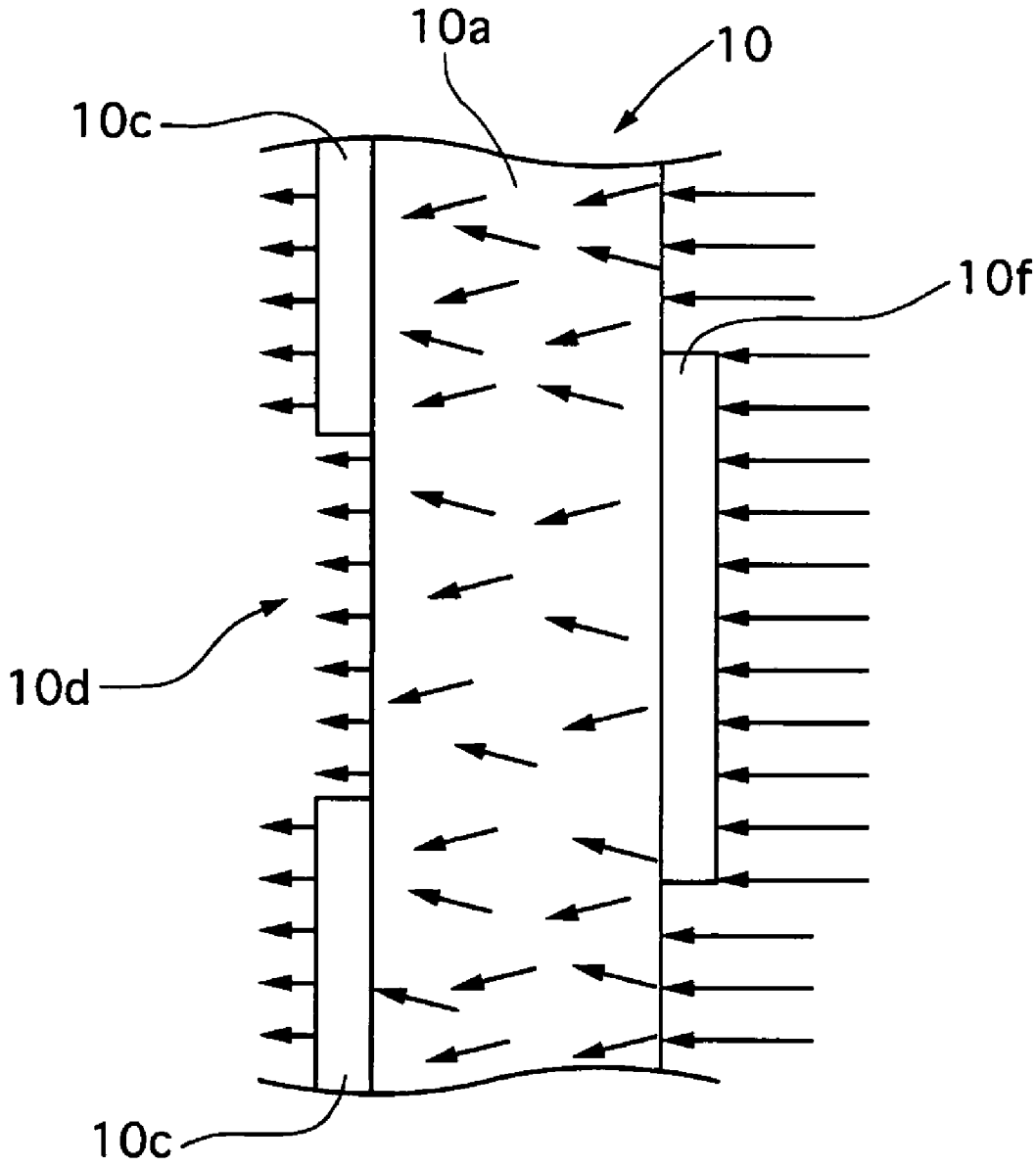
FIG. 5 is a fragmentary enlarged cross-sectional view, indicated in a circle B in FIG. 4, of the color filter with the printed area parts in a state that light enters the color filter.

Note that the light enters the diffusion sheet 10*a* except the printed dimmer area parts 10*f* without substantial impairment of brightness, and is diffused in the diffusion sheet 10*a* to travel forward as shown in FIG. 5. This diffusion of the light brings brightness difference to be small among the first printed area parts 10*b*, the second printed area parts 10*c*, and the printed dimmer area parts 10*f*.

Accordingly, the first printed area parts 10*b* pass the light to provide the first display 12 in bright, because the first light source 3 casts the blue light as indicated by the line 24 in FIG. 6 and the first printed area parts 10*b* have the filter transmission efficiency indicated by the dot line 23 in FIG. 6.

The brightness of an overlapping portion of the first light source 3 and the diffusion sheet 10*a* is suppressed by light-diffusion function of the diffusion sheet 10*a*, which brings the first display 12 to be uniformly provided. The printed dimmer area parts 10*f* decrease the brightness of the blue light passing through the overlapped area parts 10*d*, without changing its color.

In this case, the second printed area parts 10*c* prevent transmittance of the light emitted from the first light source 3, because the first light source 3 casts the blue light as indicated by the line 24 in FIG. 6 and the second printed area parts 10*c* have the filter transmission efficiency indicated by the dot line 21 in FIG. 6. In addition, the printed background area parts 10*e* prevent any light emitted from the first or second light sources 3 and 4 from passing therethrough. Accordingly, the circle of the first display 12 in blue is provided on the smoked lens 11 as shown in FIG. 8A, so that the user can see it.

In order to provide the second display 13, the second light source 4 is turned on to light up, while the first light source 3 is turned off.

The second printed area parts 10*c* pass red light emitted from the second light source 4 to provide the second display 13 in bright, because the second light source 4 casts the red light as indicated by the line 22 in FIG. 6 and the second printed area parts 10*c* have the filter transmission efficiency indicated by the dot line 21 in FIG. 6.

The printed dimmer area parts 10*f* decrease the brightness of the red light passing through the overlapped area parts 10*d*, without changing its color.

In this case, the first printed area parts 10*b* prevent transmittance of the light emitted from the second light source 4, because the second light source 4 casts the red light as indicated by the line 22 in FIG. 6 and the first printed area parts 10*b* have the filter transmission efficiency indicated by the dot line 23 in FIG. 6. In addition, the printed background area parts 10*e* prevent any light emitted from the first or second light sources 3 and 4 from passing therethrough. Accordingly, the letter "X" of the second display 13 in red is provided on the smoked lens 11 as shown in FIG. 8B, so that the user can see it.

As described above, the switch 1 can selectively provide the first display 12 and the second display 13 through the smoked lens 11, which is pressed by the user for moving the slider 8 backward so as to press the tact switch 5. The electronic circuit on the base plate 6 acts to judge which of the first and second display 12 and 13 is provided and whether or not the tact switch 5 is pressed, which brings the switch 1 to be used for two operation inputs. This enables operation inputting in different modes by one switch.

In this first embodiment, the printed dimmer parts 10*f* can remove printing on the overlapped area parts 10*d*. The overlapped area parts 10*d* are display parts directly connecting the first printed area parts 10*b* and the second printed area parts 10*c* with each other. Gaps between them cause deterioration of display quality, and the dislocation of the overlapped area parts 10*d* from the first or second printed area parts 10*b* and 10*c* causes light leakage. Avoidance of the above problem by printing the overlapped area parts 10*d* requires high precision printing. However, the display device of the first embodiment can be built at a low cost, because it removes printing, and therefore it does not need high precision printing.

Moreover, the display device of the switch 1 can provide high-quality displays without high precision printing, because the first display 12 and the second display 13 can be obtained by using positive printing in which the black background area parts 10*e* is printed so as to extract figurations corresponding to the first and second displays 12 and 13. The light leakage due to the dislocation of the overlapped area parts 10*d* from the first or second printed area parts 10*b* and 10*c* can be prevented. Printing the printed dimmer area parts 10*f* larger than the overlapped parts 10*d* enables the display device to be built at low cost by removing the high precision printing.

In this first embodiment, not-printing of the overlapped area parts 10*d* can avoid dislocating of components of the first and second displays 12 and 13, resulting in improvement in display quality.

The inner slanted wall portion 8*b* of the slider 8 reflects the lights emitted from the first and second light sources 3 and 4 and changes their direction to travel forward, which provides the first and second displays 12 and 13 with entirely high brightness. Accordingly, a user can see them easily at high brightness when they are displayed, and can not see the printed area parts 10*b*, 10*c*, 10*e*, and 10*f* that are subjected to sunlight but not displayed.

Providing the printed dimmer area parts 10*f* on the diffusion sheet 10*a* and not-printing of the overlapped area parts 10*d* decrease brightness difference among the overlapped area parts 10*d*, the first printed area parts 10*b*, and the second printed area parts 10*c*, making it possible to accommodate the brightness so that a user can identify its display. Accordingly, it can improve display quality.

The printed dimmer area parts 10*f* can be adjusted so as to surplus the brightness by changing the area rate of dot-printed areas and not-printed areas. This can be obtained by changing diameter of a dot, without increasing a manufacturing cost. The dots are arranged regularly to obtain uniform dimmer light, so that a user can not see these patterned dots through the diffusion sheet 10*a*. Black color of the dots can easily control the brightness to be suppressed certainly.

The gradation in the printed dimmer area parts 10*f* can decrease. Instead of using the gradation shown in FIGS. 7A and 7B, a checkered pattern shown in FIG. 9A and a lattice pattern shown in FIG. 9B may be used, respectively.

The switch 1 with the display device can be selectively operated under two displays, which is suitable for adaptation to an instrument panel, increasing freedom of design.

Figure 11:
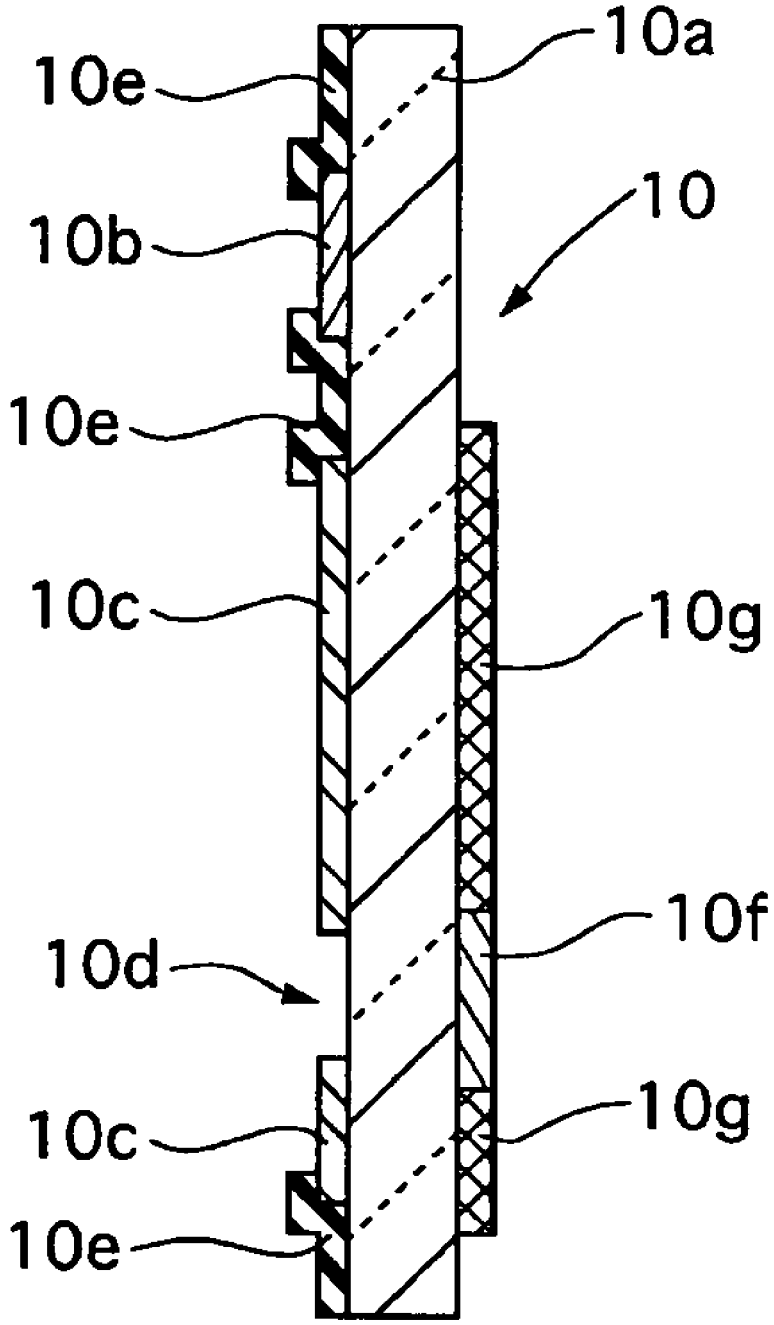
FIG. 11 is a cross-sectional view, taken on line C-C of FIG. 10A, of a color filter with printed area parts used in a display device of a second embodiment according to the present invention.

Next, a display device of a second embodiment according to the present invention will be described with reference to the accompanying drawings of FIGS. 11 to 13.

A color filter 10 has a light-diffusion sheet 10*a* having printed area parts 10*b*, 10*c*, 10*e*, 10*f*, and 10*g*. The printed dimmer area parts 10*g* are printed on a rear surface of the diffusion sheet 10*a* at areas corresponding to the second printed area parts 10*c* in addition to the printed dimmer area parts 10*f* arranged at areas corresponding to the overlapped area parts 10*d* of the first printed area parts 10*b* and the second printed area parts 10*c*. In this embodiment, the first printed area parts 10*b* have filter transmission efficiency as indicated by a dot line 25 in FIG. 13 and the second printed area parts 10*c* have filter transmission efficiency as indicated by a dot line 21 in FIG. 13.

A first light source has luminous intensity as indicated by a line 24, and a second light source has luminous intensity as indicated by a line 22.

Figure 12:
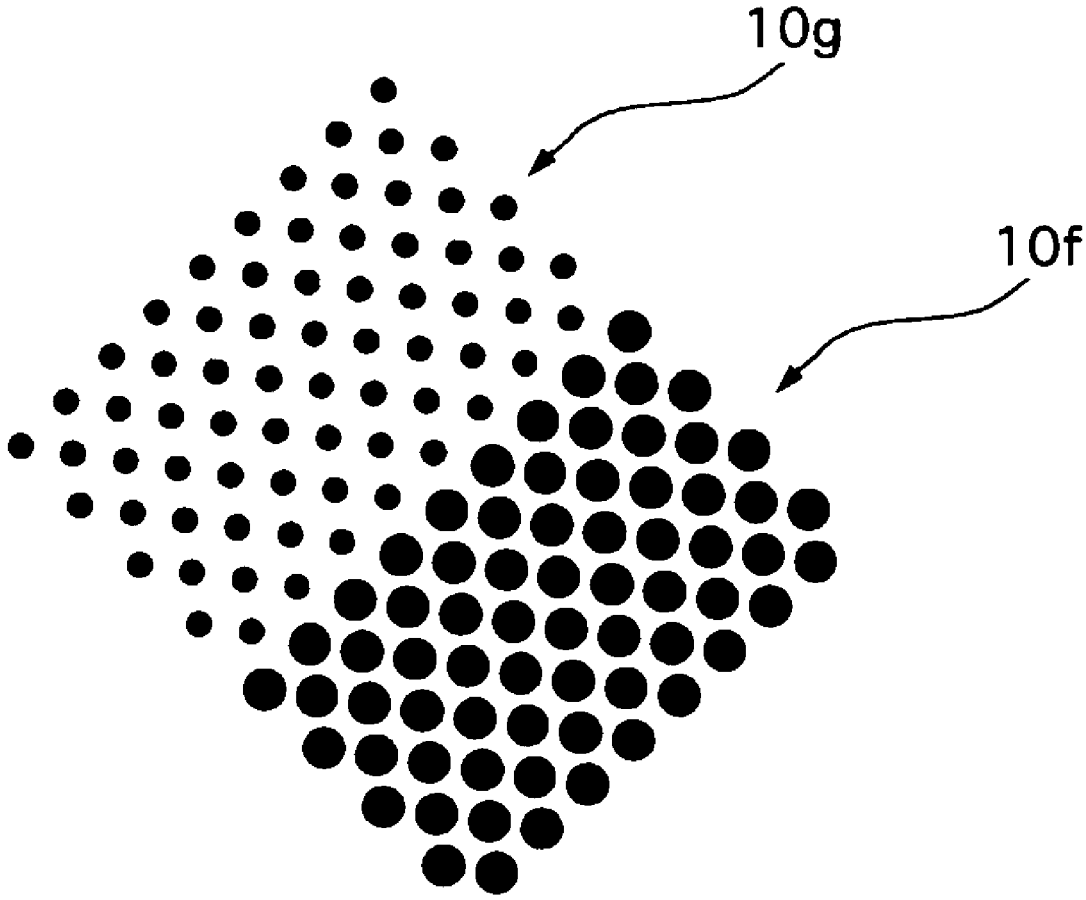
FIG. 12 is a fragmentary diagram showing a dot pattern having dots with different diameter and pitch in the printed dimmer area parts shown in FIG. 11.

The printed dimmer area parts 10*g* have a dot pattern in which intensity of black dots arranged in the printed dimmer area parts 10*g* becomes lower than that of black dots arranged in the printed dimmer area parts 10*f* as shown in FIG. 12.

The other parts are constructed similarly to those of the switch 1 with the display device of the first embodiment.

Figure 13:
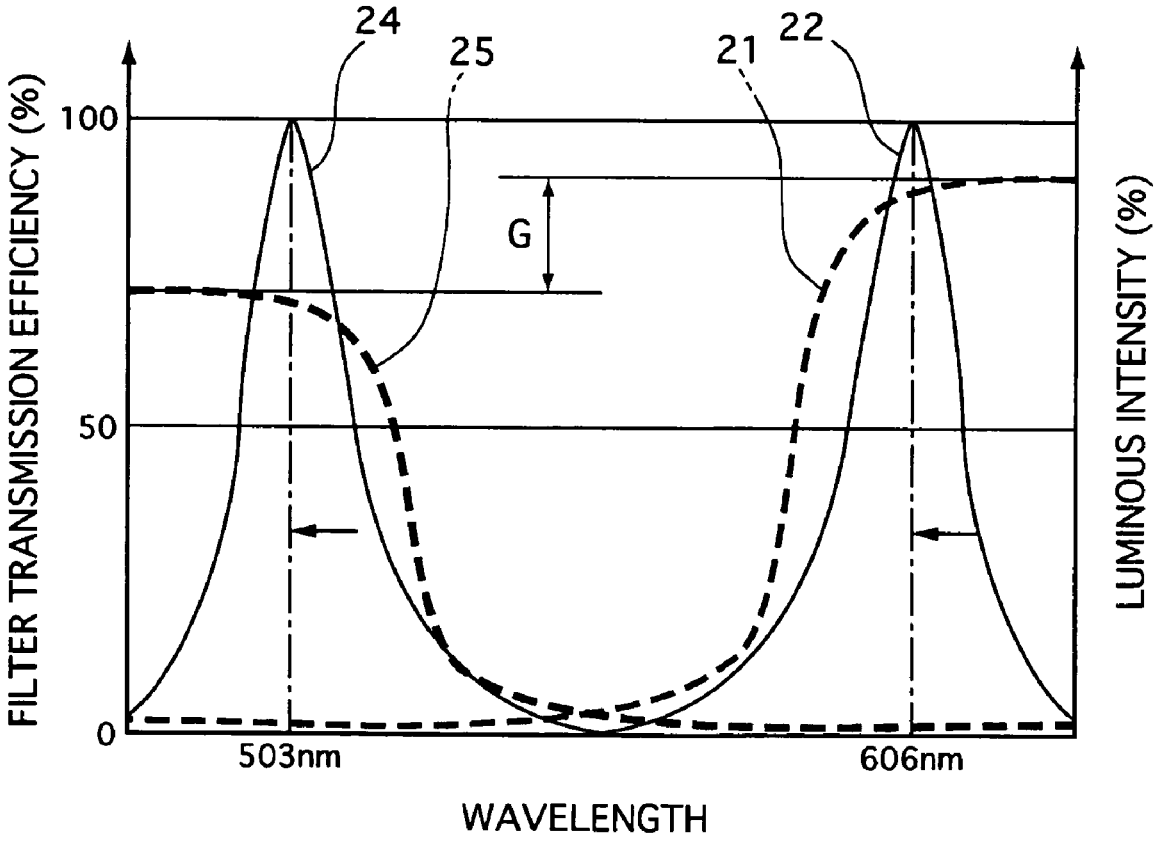
FIG. 13 is a characteristic diagram showing a relationship of luminous intensity of a first and second light sources and transmission efficiency of the color filter, which are used in a display device of the second embodiment, with respect to wavelength of light.

In this embodiment, the color filter 10 has the first and second printed area parts 10*b* and 10*c*, which causes a difference G of filter transmission efficiency between the first and second printed area parts 10*b* and 10*c* in some cases due to their characteristics as indicated a dot line 25 of the first printed area parts 10*b* and a dot line 21 of the second printed area parts 10*c* in FIG. 13. In this case, the brightness difference is notably large between a first display using light emitted from a first light source and a second display using a second light source, which results in deterioration of its display quality and appearance quality.

However, in this embodiment, the printed dimmer area parts 10*g* decrease the brightness of the second printed area parts 10*c* so as to be substantially equal to that of the first printed area parts 10*b*, which improves display quality of the display device of the second embodiment. This adjustment of the brightness is useful for providing two displays without priority.

Figure 14:
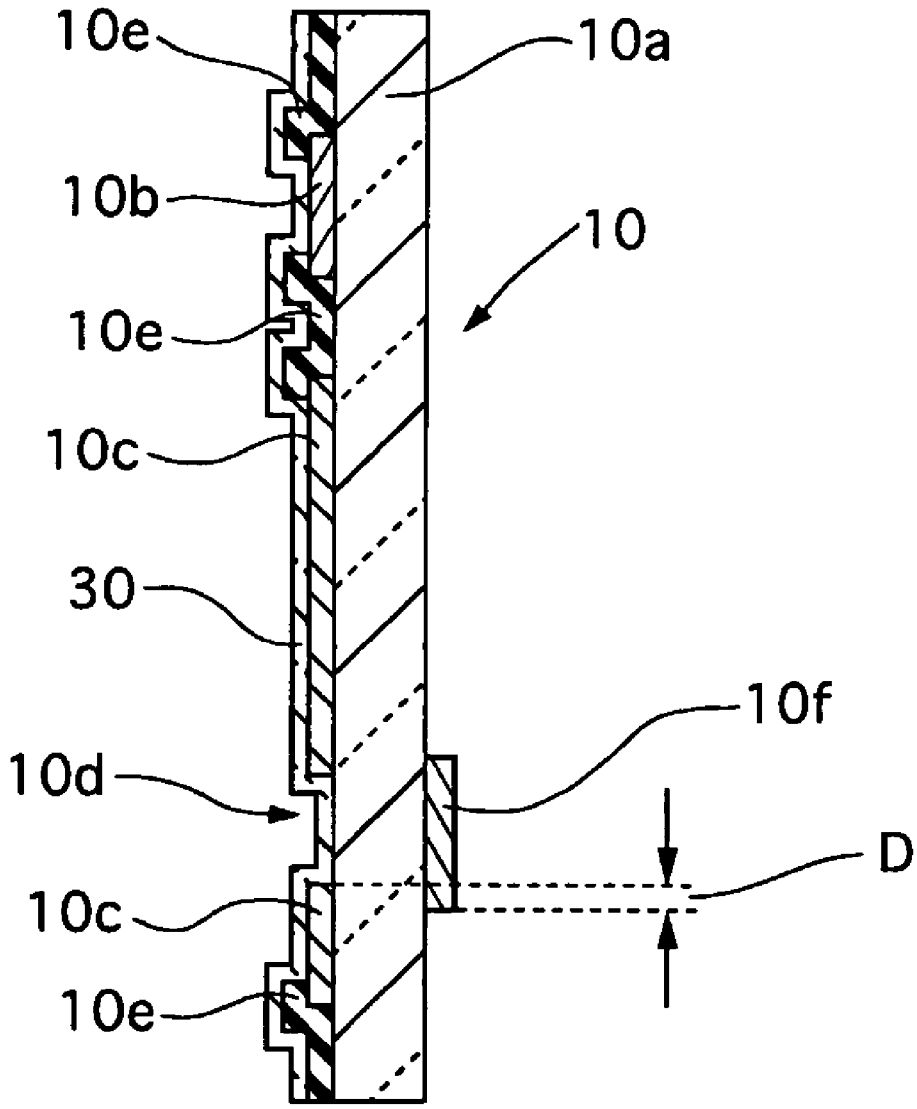
FIG. 14 is a cross-sectional view of a color filter with printed area parts used in a display device of a third embodiment according to the present invention.

Next, a switch with a display device of a third embodiment according to the present invention will be described with reference to the accompanying drawing of FIG. 14.

A color filter 10 has a light-diffusion sheet 10*a* having printed area parts 10*b*, 10*c*, 10*e*, 10*f*, and 30. The printed smoked-area parts 30 are printed on front surfaces of the first printed area parts 10*b*, the second printed area parts 10*c*, and the printed background area parts 10*e*. A smoked lens is arranged on a front surface of the printed smoked-area parts 30. The other parts are constructed similarly to those of the switch 1 with the display device of the first embodiment.

In this embodiment, the first and second printed area parts 10*b* and 10*c* have filter transmission efficiencies similar to those of the first embodiment. A first and second light sources have luminous intensities similar to those of the first embodiment.

Non-display quality in a state that the light sources are turned off is further improved by usage of the printed smoked-area parts 30 and the smoked lens, in such a way that a user can not see the first and second printed area parts 10*b* and 10*c* that are subjected to the sunlight but not displayed.

Figure 15:
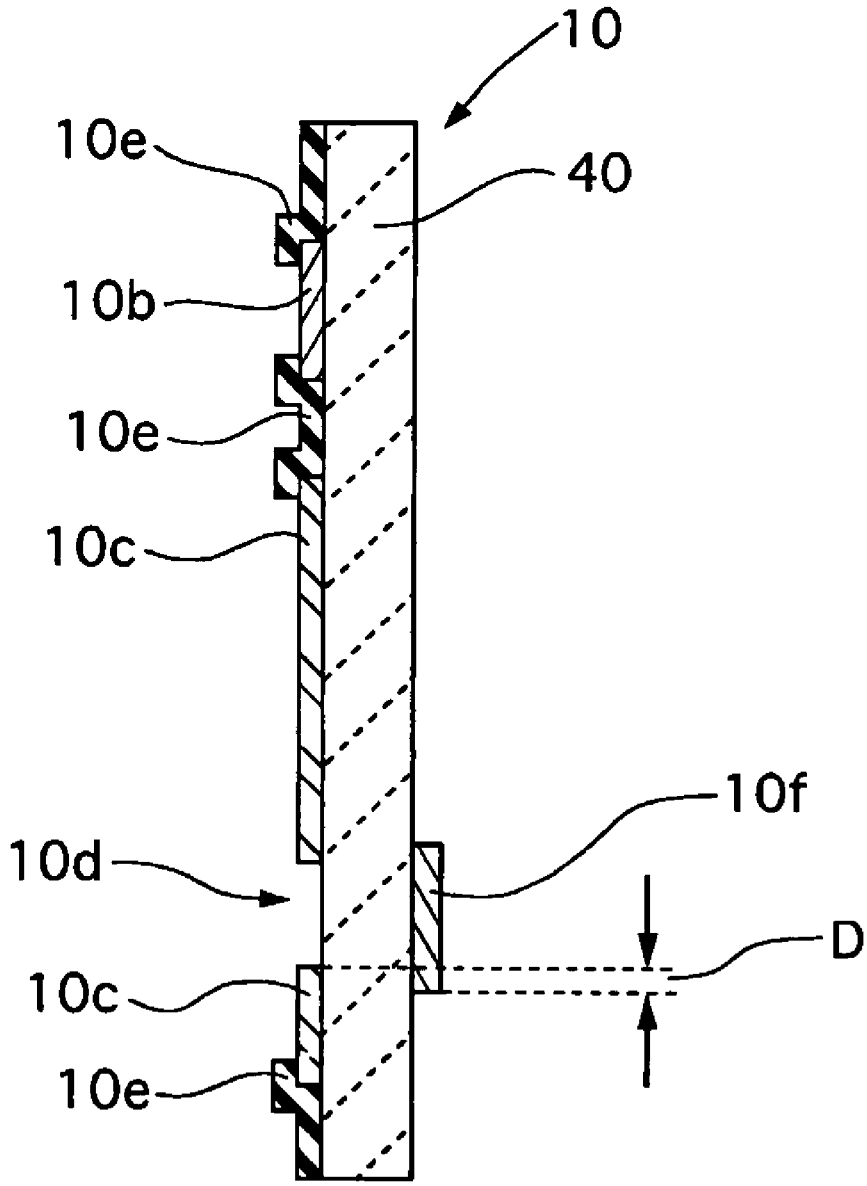
FIG. 15 is a cross-sectional view of a color filter with printed area parts used in a display device of a fourth embodiment according to the present invention.

Next, a switch with a display device of a fourth embodiment according to the present invention will be described with reference to the accompanying drawing of FIG. 15.

A color filter 10 has a transparent sheet 40 instead of the light-diffusion sheet 10*a* of the first embodiment. The other parts are constructed similarly to those of the switch 1 with the display device of the first embodiment.

According to configurations, dimensions, and/or colors of first and second displays, there are cases in which the transparent sheet 4 is superior to the light-diffusion sheet 10*a* in visibility: a case in which brightness is prior to others for drawing a user's attention because of a small display, and a case in which faded color is used for displaying, for example.

While there have been particularly shown and described with reference to preferred embodiments thereof, it will be understood that various modifications may be made therein, and it is intended to cover in the appended claims all such modifications as fall within the true spirit and scope of the invention.

For example, the first and second light sources of the first and second embodiments are set to emit light having peak wavelength of about 500 nm and light having peak wavelength of about 600 nm, but they may use a light source capable of emitting light having characteristics of different peak wavelength, other colors, such as green.

The number of light sources and printed area parts of a color filter may be set arbitrarily.

Printed area parts, such as the first printed area parts 10*b*, the second printed area parts 10*c*, the background area parts 10*e*, and the printed dimmer area parts 10*f* and 10*g* may be formed by using any one of silk-screen print making, relief printing, or ink jet printing.

The printed dimmer area parts 10*f* and/or 10*g* are not limited to those shown in FIGS. 7 and 9. They may be formed by using negative/positive inversion of them.

The gradation of the printed dimmer area parts 10*f* and/or 10*g* may be obtained by changing at least one of diameter of a dot and a pitch of dots arranged in them.

The entire contents of Japanese Patent Application No. 2004-067976 filed Mar. 10, 2004 is incorporated herein by reference.

What is claimed is:

1. A display device that selectively provides a first display and a second display, the display device comprising:

a first light source to emit a first light;

a second light source to emit a second light having a peak wavelength different from a wavelength of the first light; and a translucent sheet that is hit selectively by one of the first and second lights, said translucent sheet having a first surface and a second surface opposite to the first surface, wherein said translucent sheet comprises:

a first printed area part formed on the first surface of said translucent sheet and excluding an overlapped area part of the first display and the second display, through which the first and second light can pass, the overlapped area part being a non-printed area part and being directly connected with the first printed area part and a second printed area part to respectively form a part of the first and second displays, the first printed area part being capable of passing only the first light such that the first printed area part and the overlapped area part provide the first display when the first light is emitted, the second printed area part formed on the first surface and excluding the overlapped area part, the second printed area part being capable of passing only the second light such that the second printed area part and the overlapped area part provide the second display when the second light is emitted, a third printed area part formed on the first surface to prevent transmittance of the first and second lights and to form a background, and a printed dimmer area part formed on the second surface at areas corresponding to the overlapped area part of the first and second displays so as to suppress the first and second lights so as to cover the overlapped area part and decrease the brightness difference between the first and second lights which pass through the overlapped area part and the first and second lights which pass through the first and second printed area parts, respectively, wherein said printed dimmer area part is formed to have an area larger than an area of the overlapped area part so as to overlap with a portion of the first printed area part, which abuts on the overlapped area part, and a portion of the second printed area part, which abuts on the overlapped area part, and wherein the first and second displays can be displayed uniformly in brightness between the overlapped area part and the first printed area part and between the overlapped area part and the second printed area part when the first and second lights are emitted, respectively.

2. The display device according to claim 1, wherein said printed dimmer area part is formed to have an overlapped area portion of said printed dimmer area part and said first printed area part and another overlapped area portion of said printed dimmer area part and said second printed area part, said overlapped portions including printed area parts and non-printed area parts that are arranged regularly.

3. The display device according to claim 2, wherein the printed area parts of the printed dimmer area part are printed in black.

4. The display device according to claim 2, wherein said printed dimmer area part is formed to have gradation obtained by gradually changing an area rate of the printed area parts of the printed dimmer area part and the non-printed area parts of the printed dimmer area part.

5. The display device according to claim 4, wherein the printed area parts of the printed dimmer area part are printed in black.

6. The display device according to claim 5, wherein said printed dimmer area part is formed to have one of a dot pattern in which round dots are arranged regularly, in a lattice pattern, and in a checkered pattern.

7. The display device according to claim 4, wherein said printed dimmer area part is formed to have one of a dot pattern in which round dots are arranged regularly, in a lattice pattern, and in a checkered pattern.

8. The display device according to claim 1, wherein said printed dimmer area part is formed to have an overlapped area portion of said printed dimmer area part and said first printed area part and another overlapped area portion of said printed dimmer area part and said second printed area part, said overlapped portions having gradation obtained by gradually changing an area rate of printed area parts of the printed dimmer area part and non-printed area parts of the printed dimmer area part.

9. The display device according to claim 8, wherein the printed area parts of the printed dimmer area part are printed in black.

10. The display device according to claim 8, wherein said printed dimmer area part is formed to have one of a dot pattern in which round dots are arranged regularly, in a lattice pattern, and in a checkered pattern.

11. The display device according to claim 1, wherein said printed dimmer area part is formed to have an overlapped area portion of said printed dimmer area part and said first printed area part and another overlapped area portion of said printed dimmer area part and said second printed area part, said overlapped portions having one of a dot pattern in which round dots are arranged regularly, in a lattice pattern, and in a checkered pattern.

12. The display device according to claim 1, wherein said printed dimmer area part is further formed to have an area corresponding to overlapped area portions of said printed dimmer area portions and one of the first and second displays excluding the overlapped area parts.

* * * * *